US008206235B1

(12) United States Patent
Sardo

(10) Patent No.: US 8,206,235 B1
(45) Date of Patent: Jun. 26, 2012

(54) DUAL RING SIGHTING SYSTEM FOR PROVIDING VISUAL FEEDBACK DURING COMPLETE GOLF SWING

(76) Inventor: Lou Sardo, La Canada, CA (US)

( * ) Notice: Subject to any disclaimer, the term of this patent is extended or adjusted under 35 U.S.C. 154(b) by 0 days.

(21) Appl. No.: 12/456,739

(22) Filed: Jun. 22, 2009

(51) Int. Cl.
*A63B 69/36* (2006.01)

(52) U.S. Cl. ..... 473/268; 473/257

(58) Field of Classification Search ..... 473/218, 473/219, 220, 257, 261, 262, 264, 266, 268, 473/269, 270, 272
See application file for complete search history.

(56) References Cited

U.S. PATENT DOCUMENTS

| | | | | |
|---|---|---|---|---|
| 1,091,186 | A * | 3/1914 | Brown | 33/227 |
| 3,656,752 | A * | 4/1972 | Moriarty | 473/261 |
| 3,853,325 | A * | 12/1974 | Easterbrook | 473/268 |
| 4,521,023 | A | 6/1985 | Williams | 273/183 |
| 5,211,400 | A * | 5/1993 | Hall et al. | 473/268 |
| 5,375,844 | A * | 12/1994 | Waud | 473/268 |
| 5,577,729 | A | 11/1996 | Sabour | 273/274 |
| 6,343,998 | B1 | 2/2002 | Tarulli et al. | 473/273 |
| 6,458,041 | B1 * | 10/2002 | Brandt | 473/268 |
| 7,150,683 | B2 | 12/2006 | Bender | 473/266 |
| 7,172,515 | B2 | 2/2007 | Cost et al. | 473/261 |
| 7,204,766 | B1 | 4/2007 | Rose et al. | 473/274 |
| 7,465,242 | B2 | 12/2008 | Ward et al. | 473/409 |

* cited by examiner

*Primary Examiner* — Nini Legesse
(74) *Attorney, Agent, or Firm* — Goldstein Law Offices, P.C.

(57) ABSTRACT

A sighting device, for use by a golfer while standing on a ground surface and gazing at a golf ball upon the ground surface at a natural viewing angle, and hitting the golf ball. The device has a stand which includes a base for resting on the ground surface in front of the golfer, and a vertical mast. A pair of rings are suspended by the vertical mast in the path of the natural viewing angle. The rings have alignment indicia. Accordingly, the golfer observes the golf ball through the rings with both rings are concentric with the golf ball, and the alignment indicia of both rings are arranged in a straight line. Any movement of the golfer's head during the golf swing is immediately revealed to the golfer by a change in relative position between the rings and ball, and the alignment indicia deviating from a straight line.

5 Claims, 3 Drawing Sheets

DUAL RING SIGHTING SYSTEM FOR PROVIDING VISUAL FEEDBACK DURING COMPLETE GOLF SWING

BACKGROUND OF THE INVENTION

The invention relates to a golf sighting system. More particularly, the invention relates to system that employs two rings, placed within the golfer's visual path, to provide feedback to the golfer about undesirable head movements during the golfer's complete golf swing.

Cultivating a proper golf swing is one of the most difficult and time consuming activities, comparable to the most complex of all sporting skills. Beyond the mechanics of the proper swing itself, a key element is controlling and preventing extraneous body movements. Such movements can "throw off" the swing, and be the difference between achieving phenomenal results, and achieving mediocre to poor results.

Among the movements that a good golfer has under control, is head movements during the swing. In particular, with regard to the backswing, the head should not move. In this regard, while a little side to side movement may be acceptable, vertical or up and down movement during the backswing can have disastrous consequences on the ensuing forward swing. It should be further noted that such head movements are often merely symptomatic of body movements that end up altering the position of the head.

In addition, a significant element in the golf swing is proper positioning of the body with respect to the ball. In particular, getting too close to the ball will alter the posture and thus the swing. Accordingly, proper body positioning of the more difficult aspects for a golfer to regulate. Thus, once a golfer makes a successful shot, it is often difficult to duplicate that shot, since it is difficult for the golfer to duplicate the exact position of the ball, and the exact positioning of the golfer with respect to that ball.

To date, a myriad of training techniques and devices have been proposed that seek to train the golfer to eliminate extraneous head movements. None of these systems, methods, or devices offer the immediate visual feedback provided by the present invention.

While these units may be suitable for the particular purpose employed, or for general use, they would not be as suitable for the purposes of the present invention as disclosed hereafter.

SUMMARY OF THE INVENTION

It is an object of the invention to produce a device which aids a golfer in learning to make a proper swing such that his head does not move up or down during the swing. Accordingly, the device provides immediate visual feedback to either confirm that the golfer's head has not moved vertically during the swing, or to reveal any undesired vertical head movement during the swing.

It is another object of the invention to produce a device which immediately reveals an undesirable head movement. Accordingly, the device has a pair of rings, through which the ball is viewed immediately prior to the swing. When the head remains stationary during the swing, the rings will remain aligned within the visual path of the golfer. If the head subsequently moves, such that the rings are no longer concentric, and the alignment indicia located on the rings have altered position—the golfer's head movement is thus revealed. During the follow through portion of the swing, as the golfer shifts his weight toward the front and turns his head, the alignment indicia will "move" in a straight line as the rings cross within the golfer's view.

It is a further object of the invention to provide a device that may be used on the golf course, during play. Accordingly, the device placed immediately in front of the golfer, and the arms are suspended over the ball, such that they match up with the natural viewing angle of the golfer, and do not interfere with the club or the golfer's arms during a full golf swing.

It is yet a further object of the invention to provide a device that is inexpensive to manufacture so that is may be sold inexpensively.

It is still a further object of the invention to provide a device that allows a successful shot to be duplicated. Accordingly when the ball and golfer are positioned such that the ball is viewed through the rings perfectly centered, then both the golfer and the ball are set up to duplicate the shot.

The invention is a A sighting device, for use by a golfer while standing on a ground surface and gazing at a golf ball upon the ground surface at a natural viewing angle, and hitting the golf ball. The device has a stand which includes a base for resting on the ground surface in front of the golfer, and a vertical mast. A pair of rings are suspended by the vertical mast in the path of the natural viewing angle. The rings have alignment indicia. Accordingly, the golfer observes the golf ball through the rings with both rings are concentric with the golf ball, and the alignment indicia of both rings are arranged in a straight line. Any movement of the golfer's head during the golf swing is immediately revealed to the golfer by a change in relative position between the rings and ball, and the alignment indicia deviating from a straight line.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
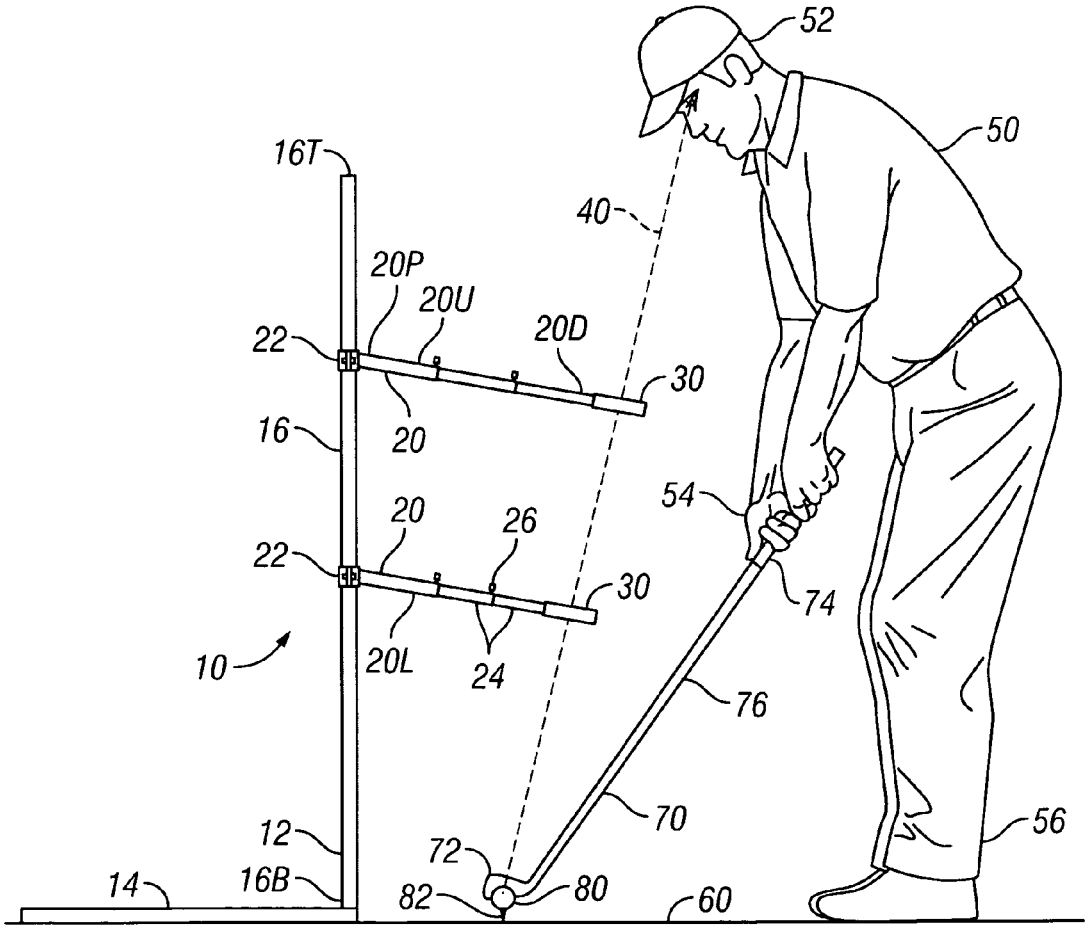
FIG. 1 is a front elevational view, illustrating the present invention, per se, positioned over a teed golf ball, with a golfer addressing said golf ball, and with both rings of the present invention and the ball aligned with the visual path of the golfer.

FIG. 1 illustrates a golfer 50 having a head 52, hands 54, and feet 56. The golfer 50 is standing upon a ground surface 60, and is holding a golf club 70 having a club head 72, a hand grip 74, and a shaft 76 extending between the club head 72 and hand grip 74. Note that the golfer 50 illustrated is male. Accordingly the terms "he", "him", and "himself" may be used herein when referring to the golfer 50 solely for the sake of consistency. The golfer 50 is illustrated holding the hand grip 74 of the golf club 70 with his hands 54, and addressing a golf ball 80, suspended on a tee 82.

Also illustrated in FIG. 1 is a sighting device 10, comprising a stand 12 having a base 14 that is resting upon the ground surface 60, and a vertical mast 16 extending upwardly therefrom, substantially perpendicular to the base 14 and ground surface 60. The base 14 is situated in front of the golfer 50 on the ground surface 60. The vertical mast 16 has a bottom 16B where it is attached to the base 14, and has a top 16T fully opposite therefrom. A height of the vertical mast 16 is defined as a distance between the bottom 16B and top 16T. The height of the vertical mast 16 is preferably two to five feet.

The device 10 has a pair of arms 20 that are secured to the vertical mast 16, including an upper arm 20U and a lower arm 20L. Each of the arms 20 has a proximal end 20P where it is secured to the vertical mast 16, and a distal end 20D fully opposite from the vertical mast 16. A ring 30 is secured at the distal end 20D of each of the arms. Each arm 20 has a clamp 22 at the proximal end 20P for securing to the vertical mast 16. The clamp 22 preferably is configured to allow height adjustment of each of the arms 20 upon the vertical mast 16. In addition, each of the arms 20 has a plurality of telescoping parts 24, and associated fixing members 26 (which may be a set screw, detent, pin, or the like), for selectively allowing the arms 20 to be adjusted in length, and then to fix the relative positioning of the telescoping parts 24 at a desired length, using the fixing members 26

In accordance with the principles of the present invention, and as illustrated in FIG. 1, as he addresses the golf ball 80 with the golf club 70, the golfer 50 is looking at the ball 80 along a viewing angle 40 which is centrally aligned with both rings 30 and the ball 80. The viewing angle 40 illustrated is a natural viewing angle for the golfer 50, such that when his feet 56 are a proper distance from the ball, and his body 51 is positioned for a proper golf swing, his gaze naturally follows the viewing angle 40 as illustrated.

Figure 2:
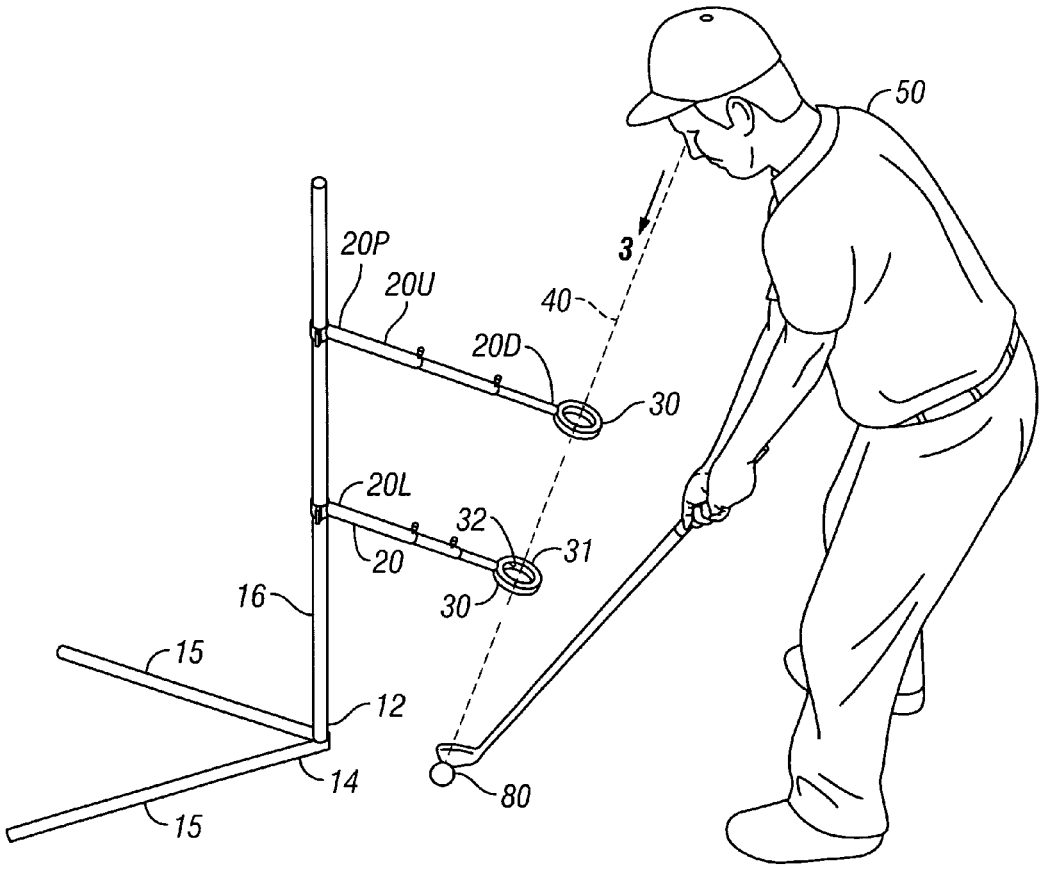
FIG. 2 is a diagrammatic perspective view, similar to FIG. 1.

Referring now to FIG. 2, the base 14 may be configured simply using a pair of base members 15 that are splayed horizontally at an acute angle and have sufficient weight to lend stability to the vertical mast 16, arms 20, and rings 30 supported thereby. Each of the rings 30 has a periphery 31, and a central opening 32. The device 10 is positioned so that the viewing angle 40 extends through both central openings 32. In order to make the viewing angle 40 fit comfortably with the proper and expected angle that the golfer ordinarily views the golf ball—i.e. the natural viewing angle—the arms 20 extend from the mast 16 at a slight downward angle, such that the distal end 20D is significantly lower than the proximal end 20P. In addition, the rings 30 are set so that the ring 30 attached to the upper arm 20U is closer to the golfer than the ring 30 attached to the lower arm 20L. the arms 20 are arranged such that the lower arm 20L is shorter in length than the upper arm 20U. Together, the relative arrangement of arm lengths and the downward angling of the arms 20 allows the viewing angle 40 to be achieved such that it is natural for the golfer 50 while being aligned with the ball 80 and extending centrally through both rings 30.

The arms 20 are spaced apart on the vertical mast 16, at significantly different heights. Note that the greater the distance between the arms 20 (and thus the rings supported thereby), the greater the degree of alignment precision achieved using the device in the manner described hereinafter. With empirical experimentation, the arms 20 may be adjusted in relative height, and in relative length, so as to fit naturally with the golfer's own height and the natural viewing angle of the ball. In general, the goal of the device 10 is to fit within the natural viewing angle of an accomplished golfer so as to provide the feedback discussed hereinafter. For a fledgling golfer, then, when properly set up, the device 10 will aid the golfer to overcome bad habits and to position his body correctly to achieve the natural viewing angle described above. In addition, the positioning of the stand 12, including how the arms suspend the rings 30 in front of the golfer's view at a substantial distance from the stand, allow the device to effectively function without physically interfering with the golfer or the golf swing.

Figure 3:
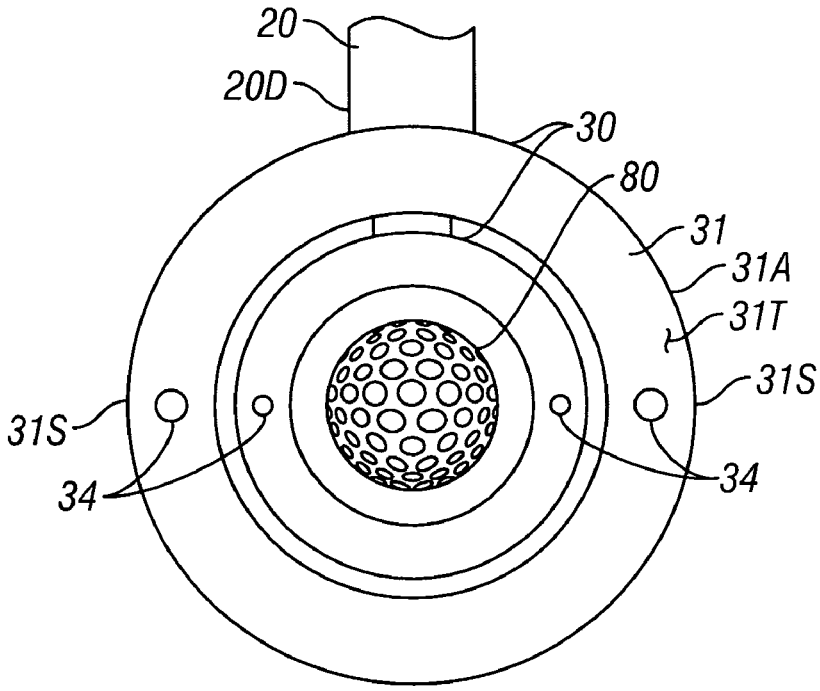
FIG. 3 is a top plan view, taken in the direction of arrow 3 in FIG. 2, illustrating how the golfer sees the rings aligned with the golf ball, prior to hitting the ball.

FIG. 3 depicts what the golfer sees when gazing at the ball 80 through the rings 30, along the viewing angle 40 as indicated by arrow 3 in FIG. 2. The rings 30 each have a center, and the rings 30 are concentric—both with each other and with the ball 80. The periphery 31 has an outer edge 31A and a periphery top 31T. The periphery 31 also has a pair of side edges 31S which are one hundred eighty degrees opposite each other and are each substantially ninety degrees from the distal end 20D of the arm 20 that they are attached to.

Alignment indicia 34 is located on the periphery top 31T near the side edges 31S. The alignment indicia 34 preferably takes the form of an alignment dot that is located on the top surface 31T near each of the side edges 31S. The alignment indicia 34 for each ring 30 are positioned along a straight line that extends through the center of said ring 30. When the golfer gazes at the ball 80 through the rings 30 along the viewing angle 40 indicated in FIGS. 1 and 2, the golfer will see the alignment indicia 34 from both rings 30 arranged in a straight line (as indicated in FIG. 3).

Figure 4:
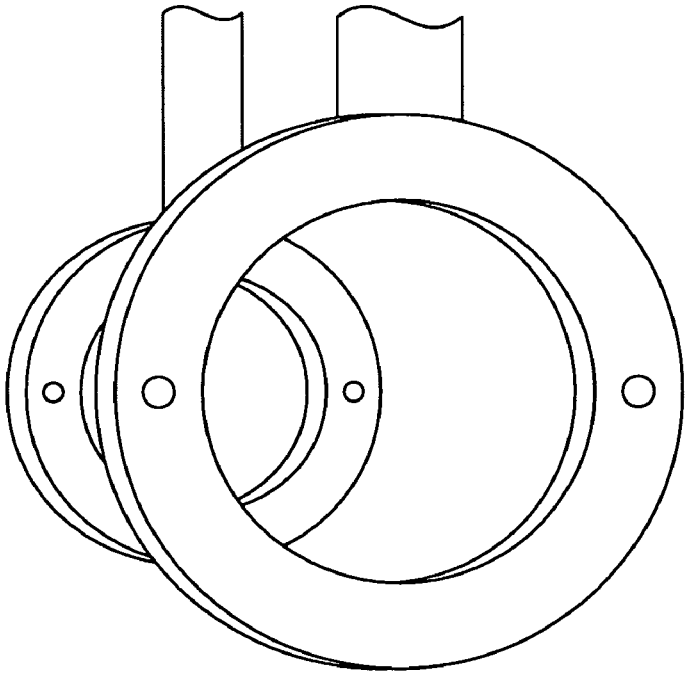
FIG. 4 is a top plan view, illustrating the rings, and further illustrating how the rings cross horizontally in a straight line as the golfer turns his head at the end of a proper golf swing.

Accordingly, just prior to hitting the ball, the golfer gazes through the rings 30 and notices the ball 80 perfectly centered within both rings 30, and the alignment indicia 34 for both rings in a straight line. As the golfer takes a backswing, and then begins the forward swing, if he has extraneous body movements that in cause his head to move, he will immediately notice such movement in the form of misalignment of the ball 80, rings 30, and alignment indicia 34. If the golfer properly swings the golf club without extraneous movements, just after the golfer hits the ball, he will see the rings 30 and indicia 34 just as in FIG. 3, except with the ball 80 missing. When the golfer takes a proper, full golf swing, after he connects with the ball and follows through to the completion of the golf swing, his weight will shift toward the forward of his two feet, and his head will begin to turn. As his head turns, his view of the rings 30 will change. Provided extraneous body and head movements have not take place and the head turns in the correct plane, the golfers will observe the rings 30 cross, as indicated in FIG. 4, with the alignment indicia "moving" relative to each other along a straight line. If the alignment indicia are offset, and not viewed on a straight line as the golfer turns his head, then the golfer is given immediate feedback about extraneous head or body movements during the swing follow-through.

In addition, following a successful shot while using the device 10, the device 10 may be used to duplicate the shot. In particular, when the golfer places the ball centered within the rings, and stands such that the ball and rings are concentric, the golfer and ball are positioned to recreate the shot exactly.

In conclusion, herein is presented a system for helping a golfer to properly align his body with the golf ball, by sighting the golf ball through a pair of rings, and then notice any extraneous head and body movements by noticing changes in alignment of the rings and ball. The invention is illustrated by example in the drawing figures, and throughout the written description. It should be understood that numerous variations are possible, while adhering to the inventive concept. Such variations are contemplated as being a part of the present invention.

What is claimed is:

1. A sighting system, for use by a golfer having a body, a head, and feet, while standing on a ground surface and hitting a golf ball using a golf club, comprising:

a stand, having a base for positioning upon the ground surface in front of the golfer, and a vertical mast extending perpendicularly upward from the stand;

a pair of arms extending laterally from the stand including an upper arm and a lower arm, for extending toward the golfer, the arms each having a proximal end secured to the vertical mast, and a distal end, the upper arm is longer and extends closer to the golfer than the lower arm, wherein the arms are each attached to the vertical mast with a clamp that allows the arms to be adjusted in height along the vertical mast;

a pair of rings, each ring having a periphery and a central opening, each ring secured to one of the arms on its periphery, wherein the ring attached to the upper arm is positioned closer to the golfer than the ring attached to the lower arm, the rings arranged so that the golfer can position his body, addressing the golf ball with the golf club, and can gaze downwardly through the rings at the ball with the golf ball concentric with both of the rings, such that the golfer will thereafter notice by a change in the relative positioning of the rings and ball within the golfer's view if the golfer's head has moved.

2. The sighting system as recited in claim 1, wherein the periphery of each of the rings has a pair of side edges that are substantially one hundred eighty degrees apart and have alignment indicia located on the periphery near the side edges, such that when gazing through the rings at the ball when the ball is viewed concentric within the rings by the golfer, the alignment indicia are all arranged on a straight line.

3. The sighting system as recited in claim 2, wherein the arms are angled to extend downwardly as the extend from the vertical mast.

4. The sighting system as recited in claim 3, wherein the arms each have telescoping sections, to allow each arm to be adjusted in length.

5. The sighting system as recited in claim 2, wherein the periphery has a top surface, and wherein the alignment indicia are a pair of alignment dots located on the periphery adjacent to the side surfaces.

* * * * *